US011285063B2

(12) United States Patent
Davis

(10) Patent No.: US 11,285,063 B2
(45) Date of Patent: Mar. 29, 2022

(54) SINGLE PORT LATERAL TRANSFER DEVICE AND ROTATIONAL POSITIONING DEVICE COMBINATION

(71) Applicant: D.T. Davis Enterprises, LTD.

(72) Inventor: David T. Davis, Bethlehem, PA (US)

(73) Assignee: D.T. Davis Enterprises, Ltd., Allentown, PA (US)

( * ) Notice: Subject to any disclaimer, the term of this patent is extended or adjusted under 35 U.S.C. 154(b) by 104 days.

(21) Appl. No.: 16/624,538

(22) PCT Filed: Aug. 14, 2018

(86) PCT No.: PCT/US2018/046688
§ 371 (c)(1),
(2) Date: Dec. 19, 2019

(87) PCT Pub. No.: WO2019/036458
PCT Pub. Date: Feb. 21, 2019

(65) Prior Publication Data

US 2021/0154069 A1 May 27, 2021

Related U.S. Application Data

(60) Provisional application No. 62/545,059, filed on Aug. 14, 2017.

(51) Int. Cl.
*A61G 7/057* (2006.01)
*A61G 7/00* (2006.01)
*A61G 7/10* (2006.01)

(52) U.S. Cl.
CPC ..... *A61G 7/05776* (2013.01); *A61G 7/001* (2013.01); *A61G 7/103* (2013.01); *A61G 7/1026* (2013.01); *A61G 2200/32* (2013.01)

(58) Field of Classification Search
CPC .. A61G 7/05776; A61G 7/001; A61G 7/1026; A61G 2200/32
See application file for complete search history.

(56) References Cited

U.S. PATENT DOCUMENTS 5,067,189 A 11/1991 Weedling et al.
6,073,291 A 6/2000 Davis
(Continued)

FOREIGN PATENT DOCUMENTS

EP 1269959 A1 1/2003
EP 3589255 9/2018
WO 2019126650 A1 6/2019

OTHER PUBLICATIONS

International Search Report and Written Opinion issued in connection with International Patent Application No. PCT/US2018/046688, dated Aug. 14, 2018, 12 pages.
(Continued)

*Primary Examiner* — David R Hare
*Assistant Examiner* — Adam C Ortiz
(74) *Attorney, Agent, or Firm* — Duane Morris LLP

(57) ABSTRACT

An inflatable transfer mattress includes a top panel, a bottom panel having a perimeter sealingly coupled to a perimeter of the top panel to define an internal volume therebetween, a first wedge pocket coupled to an outer surface of the top panel, and a first inflatable wedge. The internal volume is configured to receive an air flow therein. The first inflatable wedge is sized and configured to be inserted into the first wedge pocket and is configured to be transitioned from a deflated state to an inflated state. The first inflatable wedge is configured to rotate a patient to a predetermined angle with respect to the top panel in the inflated state.

20 Claims, 11 Drawing Sheets

(56) References Cited

U.S. PATENT DOCUMENTS

| | | | | |
|---|---|---|---|---|
| 6,701,544 | B2 * | 3/2004 | Heimbrock | A61G 7/1026 5/709 |
| 9,554,956 | B2 * | 1/2017 | Reiners | A61G 7/001 |
| 2002/0133877 | A1 | 9/2002 | Kuiper et al. | |
| 2005/0262638 | A1 | 12/2005 | Libunao | |
| 2015/0128341 | A1 | 5/2015 | Kuiper et al. | |
| 2015/0289817 | A1 | 10/2015 | Augustine et al. | |
| 2017/0049647 | A1 | 2/2017 | Rigoni et al. | |

OTHER PUBLICATIONS

Australian Patent Office, Notice of Acceptance of Australian Patent Application No. 2018318107 (dated Aug. 27, 2020).

European Patent Office, Extended European Search Report issued for corresponding European Patent Appln No. 18846455.6 (dated Mar. 30, 2021).

* cited by examiner

SINGLE PORT LATERAL TRANSFER DEVICE AND ROTATIONAL POSITIONING DEVICE COMBINATION

CROSS-REFERENCE TO RELATED APPLICATION

This application is a National Stage Application, filed under 35 U.S.C. 371, of International Patent Application No. PCT/US2018/046688, filed on Aug. 14, 2018, which claims benefit to U.S. Provisional Application Ser. No. 62/545,059, filed Aug. 14, 2017, and entitled "SINGLE PORT LATERAL TRANSFER DEVICE AND ROTATIONAL POSITIONING DEVICE COMBINATION," contents of both of which are incorporated herein by reference in their entireties.

BACKGROUND

Immobility and prolonged confinement present both psychological and physically evident pathological problems to patients, ranging from malaise, depression, feelings of helplessness and loss of motivation on the one hand to decubitus ulcers, loss of local circulation and unsanitary dermatologic insult from waste products, or edema of extremities and gangrene on the other. Not only are patients affected by these conditions but so too are the caregivers and clinicians who must lift, turn, wash, change bedding and clothes, arrange for food, treat, and dispose of waste. Such operations often require that attendants have a high level of strength and skill to move and reposition the patient, regardless of the patient's size or weight.

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet. Current patient handling mattresses provide support for patients, but do not provide rotational or turning support.

SUMMARY

In various embodiments, an inflatable transfer mattress is disclosed. The inflatable transfer mattress includes a top panel, a bottom panel having a perimeter sealingly coupled to a perimeter of the top panel to define an internal volume therebetween, a first wedge pocket coupled to an outer surface of the top panel, and a first inflatable wedge. The internal volume is configured to receive an air flow therein. The first inflatable wedge is sized and configured to be inserted into the first wedge pocket and is configured to be transitioned from a deflated state to an inflated state. The first inflatable wedge is configured to rotate a patient to a predetermined angle with respect to the top panel in the inflated state.

In various embodiments, an inflatable transfer mattress is disclosed. The inflatable transfer mattress includes a top panel, a bottom panel having a perimeter sealingly coupled to a perimeter of the top panel to define an internal volume therebetween, a first wedge pocket coupled to an outer surface of the top panel, and a first inflatable wedge. The internal volume is configured to receive an air flow therein. The bottom panel defines a plurality of holes configured to provide air flow from the internal volume to an area located between the bottom panel and a surface. The first inflatable wedge is sized and configured to be inserted into the first wedge pocket and is configured to be transitioned from a deflated state to an inflated state. The first inflatable wedge is configured to rotate a patient to a first predetermined angle with respect to the top panel in the inflated state. A first airflow path extends from a first valve to a first opening formed in the first inflatable wedge.

In various embodiments, a method is disclosed. The method includes positioning an inflatable transfer mattress on a first surface. The inflatable transfer mattress includes a top panel, a bottom panel having a perimeter sealingly coupled to a perimeter of the top panel to define an internal volume configured to receive an airflow, a first wedge pocket coupled to an outer surface of the top panel, and a first inflatable wedge sized and configured to be inserted into the first wedge pocket. A patient is positioned on the inflatable transfer mattress and the first inflatable wedge is inflated from a deflated state to an inflated state. Inflation of the first inflatable wedge rotates the patient to a first predetermined angle with respect to the top panel in the inflated state. The first inflatable wedge is inflated by an inflation device coupled to a first airflow path including a first valve formed integrally with the top panel.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
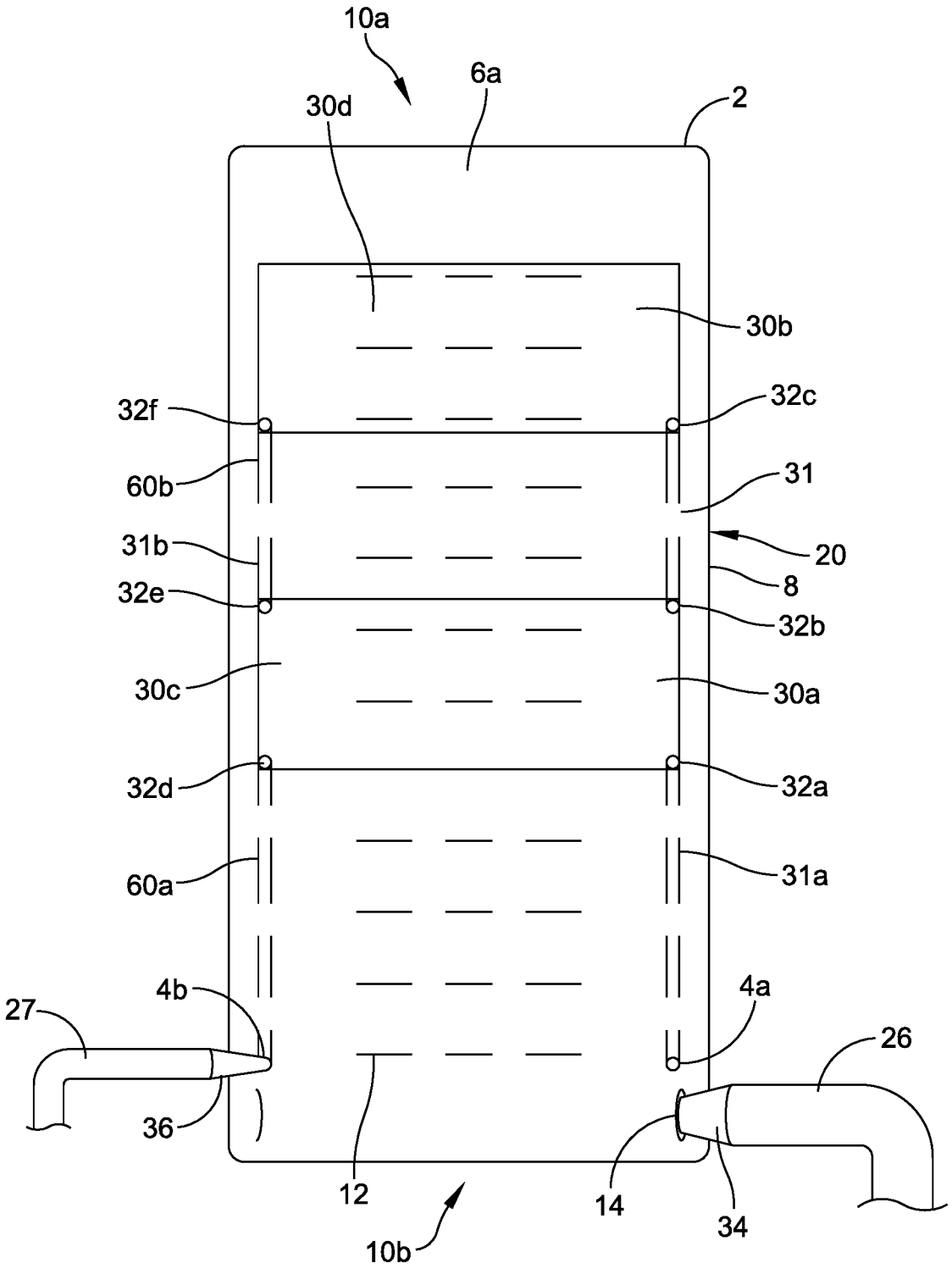
FIG. 1 illustrates a top view of an inflatable transfer mattress having a rotational positioning device formed integrally therewith, in accordance with some embodiments.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship. In the claims, means-plus-function clauses, if used, are intended to cover structures described, suggested, or rendered obvious by the written description or drawings for performing the recited function, including not only structure equivalents but also equivalent structures.

Figure 2:
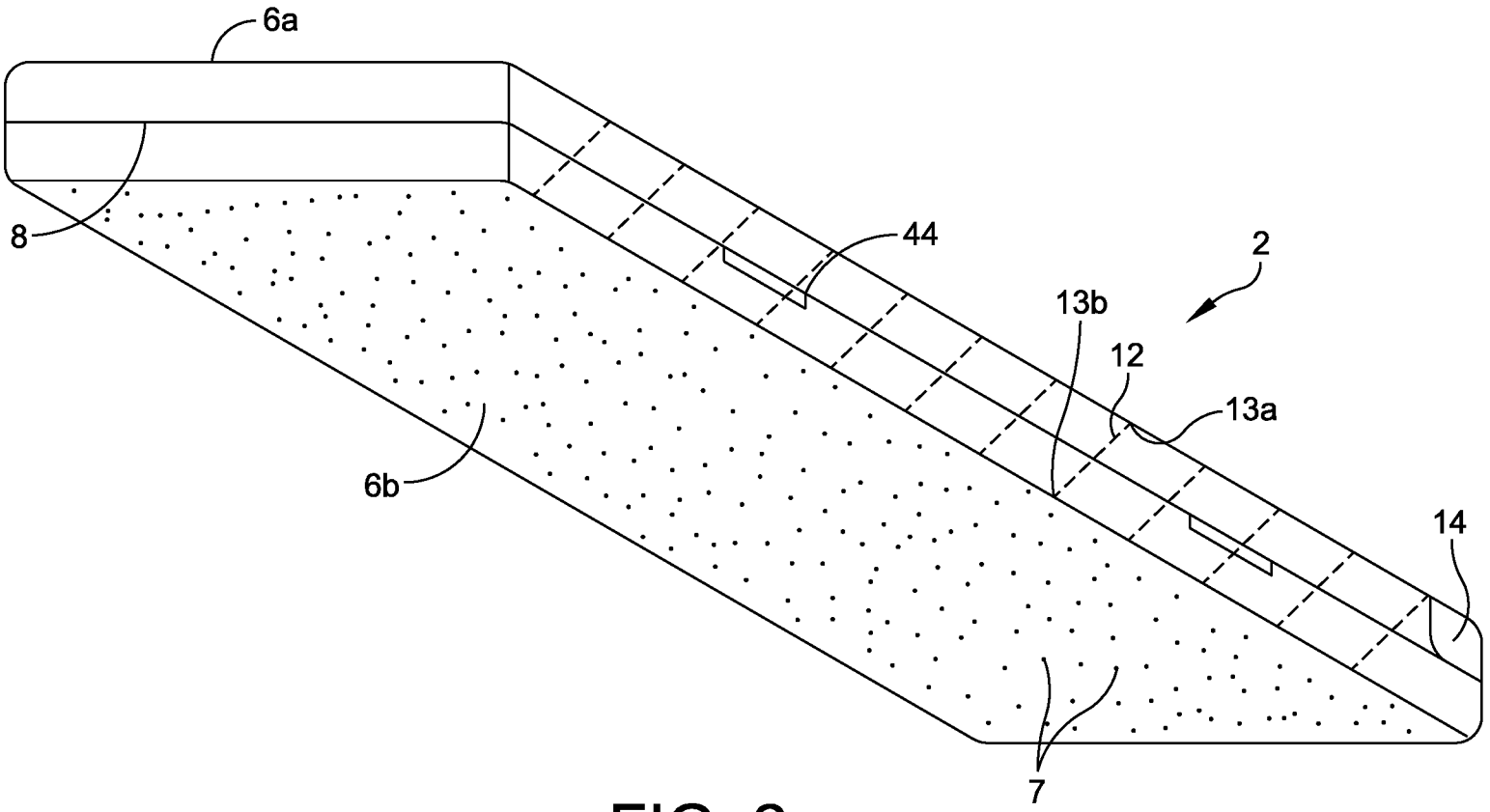
FIG. 2 illustrates a bottom perspective view of the inflatable transfer mattress of FIG. 1, in accordance with some embodiments.

FIGS. 1-2 illustrate a top view of an inflatable transfer mattress 2 having a rotational positioning device 20 formed integrally therewith, in accordance with some embodiments. The inflatable transfer mattress 2 includes a top panel 6*a*, a bottom panel 6*b*, and a plurality of stringers 12 positioned between the top panel 6*a* and the bottom panel 6*b*. The inflatable transfer mattress 2 includes a proximal (or head) portion 10*a* and a distal (or foot) portion 10*b*. The top panel 6*a* includes a head portion, a foot portion, and a peripheral edge. Likewise, the bottom panel 6*b* includes a head portion, a foot portion, and a peripheral edge, and is substantially similar in peripheral profile to top panel 6*a*. In the illustrated embodiment, the peripheral edge of the top panel 6*a* is sealingly fastened to the peripheral edge of the bottom panel 6*b* to define an internal volume between the top panel 6*a* and the bottom panel 6*b*. The top panel 6*a* is coupled to the bottom panel 6*b* at a peripheral edge 8 of the inflatable transfer mattress 2. In some embodiments, a perimeter band (not shown) is coupled between the top panel 6*a* and the bottom panel 6*b*. The perimeter band can include an elongate substantially rectangular strip, having a top edge and a bottom edge. In some embodiments, the perimeter 8 of the inflatable transfer mattress 2 is defined by a weld between the top panel 6*a* and the bottom panel 6*b*.

An inlet opening 14 is formed in a portion of the top panel 6*a* and/or the bottom panel 6*b*. The inlet opening 14 is configured to receive an air supply hose 26 coupled to an inflation device (see FIGS. 9-10) and transfer air flow from the inflation device to the internal volume defined between the top panel 6*a* and the bottom panel 6*b*. In some embodiments, the inlet opening 14 is a closeable opening that sealingly accepts the air supply hose 26. The inlet opening 14 is sized and shaped so that the air supply hose 26 (or a nozzle 34 coupled thereto) may be inserted, with the inlet 14 being thereafter snapped shut or otherwise closed to hold the air supply hose 26 in place while inflatable transfer mattress 2 is being inflated. The inlet opening 14 may include a valve that is biased to be normally closed to prevent air from exiting the inlet 14 and opened when the air supply hose 26 is inserted into inlet opening 14. Other arrangements known to those skilled in the art may be used to inflate inflatable transfer mattress 2. In embodiments including a perimeter band, features identified as being formed on the top panel 6*a* and/or the bottom panel 6*b*, such as, for example, the inlet opening 14, may be located on the perimeter band. It will be recognized that any embodiment described herein may include a perimeter band and is within the scope of this disclosure and the claims.

The bottom panel 6*a* includes a plurality of holes 7 that are defined through the bottom panel's 6*a* thickness to allow air to escape in a controlled (e.g., predetermined) manner so as to allow inflatable transfer mattress 2 to be used as a transfer mattress. The air supplied to a transfer-capable embodiment of inflatable transfer mattress 2 (i.e., air transferred into the internal volume through inlet 14) escapes through the plurality of holes 7, providing a weight-bearing cushion of air which functions as a lubricant to reduce friction and facilitate the sliding of inflatable transfer mattress 2 on a first surface 70*a*, as well as, from a first surface 70*a* to a secondary transfer surface 70*b* (see FIG. 7). The first surface 70*a* and/or the second surface 70*b* can include one or more of a bed, a stretcher, an operating table, an imaging table, and/or any other suitable surface.

The plurality of stringers 12 each comprise substantially rectangular sheets of nylon scrim or the like, and include a top edge 13*a* and a bottom edge 13*b*. Stringers 12 may have differing or varying widths, depending upon their position within inflatable transfer mattress 2. Each top edge 13*a* may be fastened longitudinally or transversely to a portion of the inner surface of top panel 6*a*, and each bottom edge 13*b* may be fastened longitudinally or transversely to a portion of the inner surface of bottom panel 6*b*. When stringers 12 are assembled in a transverse manner, they can have a narrow center section that causes at least top panel 6*a* to form a longitudinally oriented concave recess which helps to cradle a patient's legs when inflatable transfer mattress 2 is inflated with air. A similar concave recess is formed when stringers 12 are assembled in a longitudinal manner.

In some embodiments, the inflatable transfer mattress 2 includes one or more handles 44 configured to facilitate movement of the inflatable transfer mattress 2 from the first surface 70*a* to a second surface 70*b*. Each of the handles 44 are positioned along a peripheral edge 8 of the inflatable transfer mattress 2. The handles 44 can include any suitable woven and/or non-woven material coupled to the inflatable transfer mattress 2 and configured to sustain a predetermined force to allow sliding of the inflatable transfer mattress 2. In some embodiments, the handle 44 can be omitted and straps, eyelets, and/or other devices can be configured to allow handles or other transfer mechanism to be attached to and/or detached from the inflatable transfer mattress 2.

In some embodiments, the inflatable transfer mattress 2 includes a rotational positioning device 20 coupled to and/or formed integrally therewith. In the illustrated embodiment, the rotational positioning device 20 includes a plurality of air flow paths 31*a*, 31*b* extending proximally from a distal end 10*b* of the inflatable transfer mattress 2, a plurality of ports 32*a*-32*f* formed in the top panel 6*a* and in fluid communication with one of the airflow paths 31*a*, 31*b*, and a plurality of inflatable wedges 16*a*-16*d* (see FIG. 4) configured to be releasably inserted and/or integrally formed within a plurality of wedge pockets 30*a*-30*d* coupled to an outer surface of the top panel 6*a*.

Figure 3:
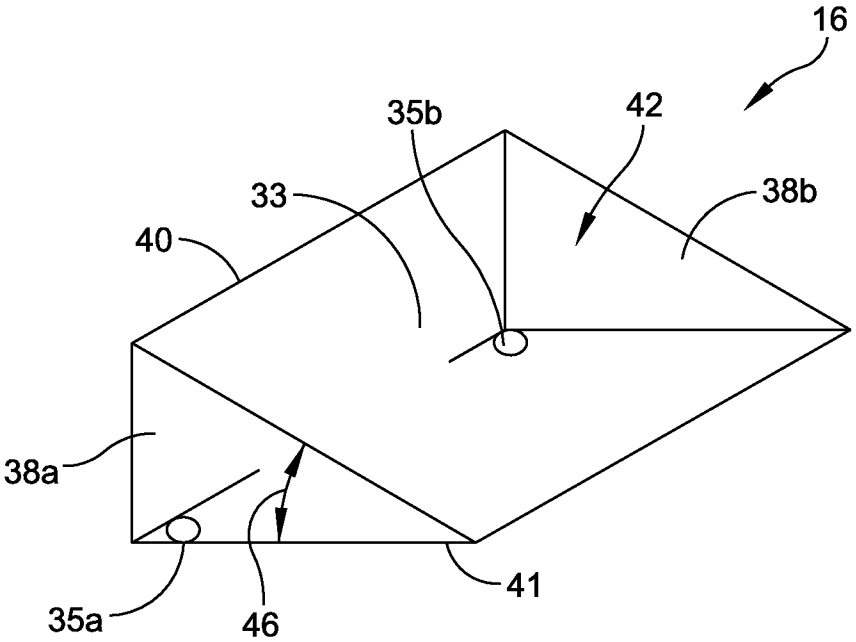
FIG. 3 illustrates an inflatable wedge configured to be inserted within a wedge pocket defined by the inflatable transfer mattress of FIG. 1, in accordance with some embodiments.

FIG. 3 illustrates an inflatable wedge 16 configured to be inserted into a selected one of the plurality of wedge pockets 30*a*-30*d*, in accordance with some embodiments. The inflatable wedge 16 includes an inflatable bladder-like construction defined by a front, or angled, surface 33, side surfaces 38*a*, 38*b*, a rear, or straight, surface 40, and a bottom surface 41. Although embodiments are discussed herein having a wedge (or three-dimensional triangular) design, it will be appreciated that the inflatable wedge 16 can have any suitable shape, such as, for example, a cuboid shape, pillow shape, a circular shape, a cylindrical shape, etc. The surfaces 33, 38*a*, 38*b* 40 define an internal pocket 42 configured to receive an air flow therein.

In some embodiments, the bottom surface 41 defines at least one opening 35*a*, 35*b* configured to be coupled to one of the air flow paths 31*a*, 31*b* defined in the inflatable transfer mattress 2. For example, in some embodiments, each of the openings 35*a*, 35*b* are sized and configured to be coupled to a flexible and/or rigid tube 60*a*, 60*b* defining an air flow path 31*a*, 31*b*. As another example, in some embodiments, the openings 35*a*, 35*b* may each include a tube (or other flow path) extending beyond the side surface 38*a*, 38*b* and configured to be inserted into ports 32*a*-32*f* formed in the top panel 6*a* of the inflatable transfer mattress 2. As yet another example, in some embodiments, the openings 35*a*, 35*b* may be configured to align with ports 32*a*-32*f* formed in the top panel 6*a* of the inflatable mattress 2 such that air exiting the ports 32*a*-32*f* travels in a predetermined path into the openings 35*a*, 35*b*. Airflow is transferred from a respective airflow path 31*a*, 31*b* to the inflatable wedge 16.

The inflatable wedge 16 is configured to be transitioned from a deflated state (see inflatable wedges 16*c*, 16*d* at FIG. 4) in which the inflatable wedge 16 is substantially flat to an inflated state (as shown in FIG. 3) in which the front surface 33 defines a predetermined angle 46 with respect to the bottom surface 41. The predetermined angle 46 can be any suitable angle, such as, for example, any angle in the range of 0-30°, 0-15°, 0-45°, and/or any other suitable range of angles. In some embodiments, the inflatable wedge 16 can be partially inflated to define a lesser angle than the predetermined angle 46. For example, the inflatable wedge 16 can be inflated to define any angle in a range up to a maximum angle, such, as for example, any angle in the range of 0-30°, 0-15°, 0-45°, and/or any other suitable range of angles.

Figure 4:
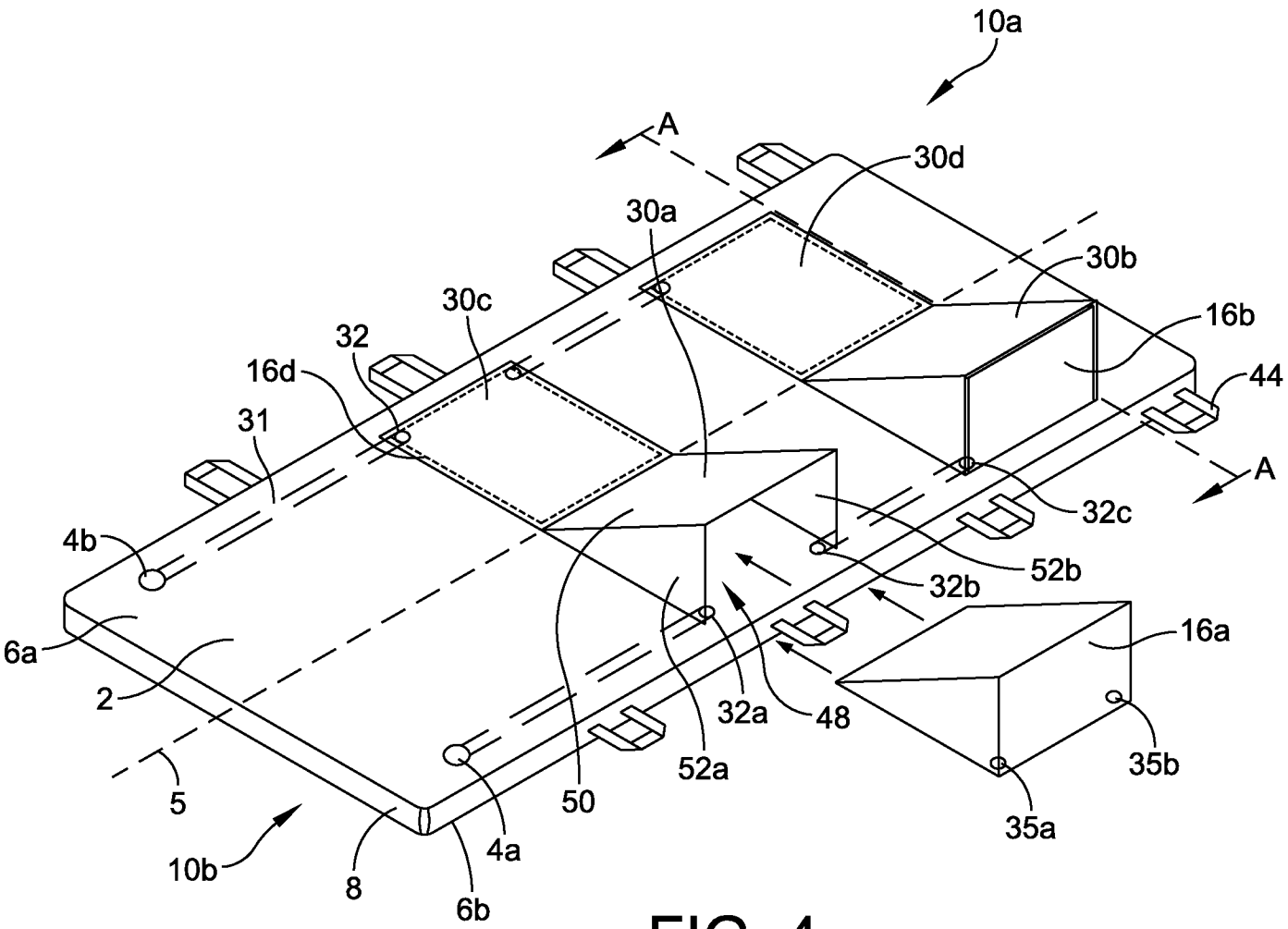
FIG. 4 illustrates a side perspective view of the inflatable transfer mattress of FIG. 1 having a plurality of inflatable wedges coupled thereto, in accordance with some embodiments.
Figure 5:
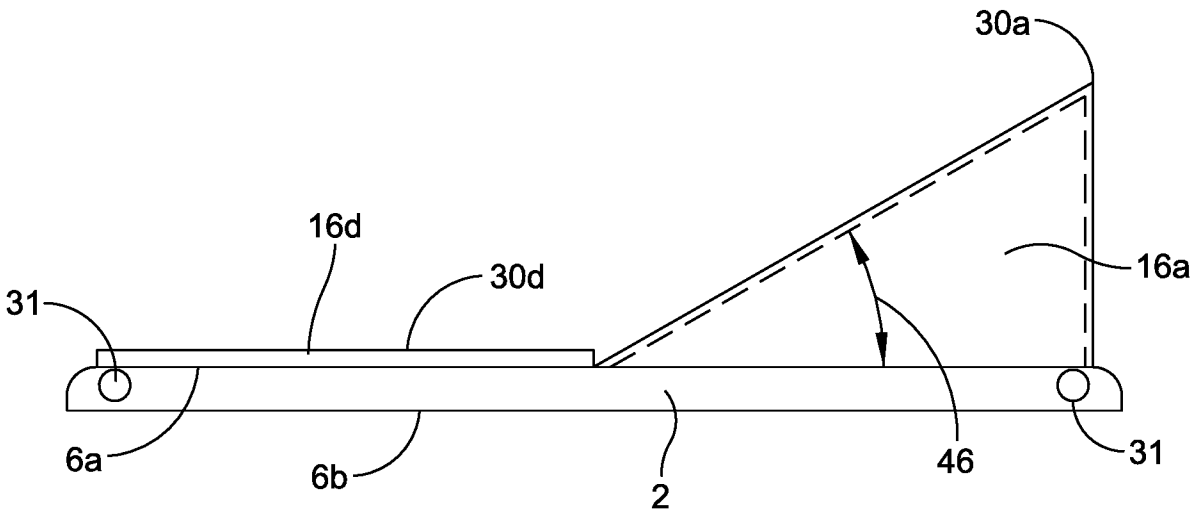
FIG. 5 illustrates a cross-sectional view of the inflatable transfer mattress of FIG. 4 taken along line A-A, in accordance with some embodiments.
Figure 6:
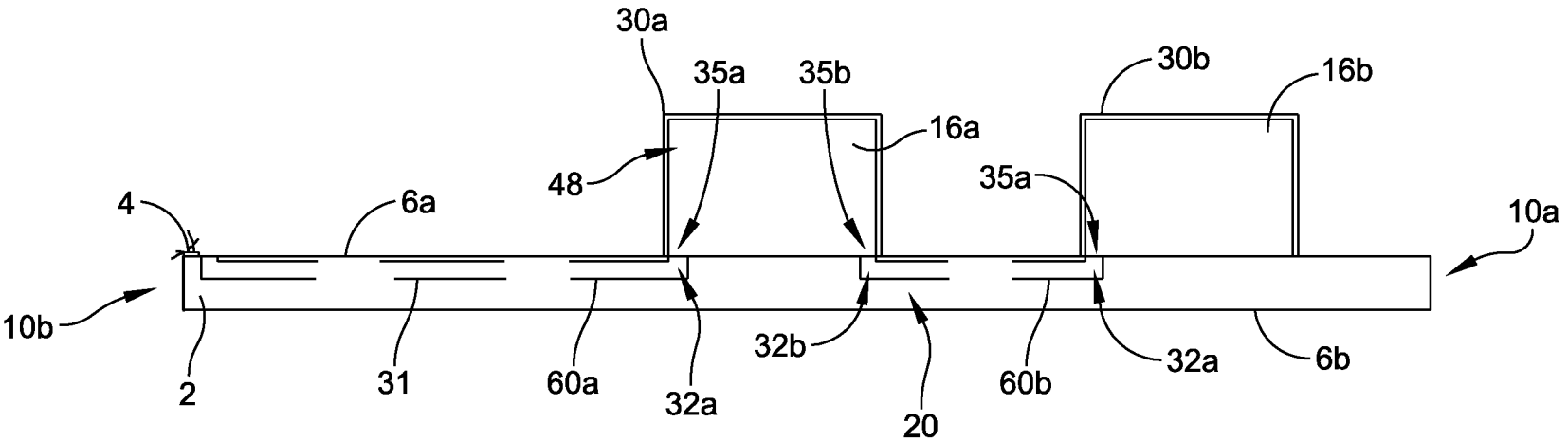
FIG. 6 illustrates a side view of the inflatable transfer mattress of FIG. 4, in accordance with some embodiments.

FIGS. 4-6 illustrate an embodiment of the inflatable transfer mattress 2 having a plurality of inflatable wedges 16*a*-16*d* coupled thereto, in accordance with some embodiments. In some embodiments, the inflatable transfer mattress 2 includes a plurality of wedge pockets 30*a*-30*d* coupled to and/or formed integrally with the top panel 6*a* of the inflatable transfer mattress 2. Each of the plurality of wedge pockets 30*a*-30*d* includes a first sidewall 52*a* and a second sidewall 52*b* coupled to a front wall 50 and to the top panel 6*a*. Each of the wedge pockets 30*a*-30*d* defines a shape complimentary to the shape of the inflatable wedges 16*a*-16*b* in an inflated state. For example, in the illustrated embodiment, the inflatable wedges 16*a*-16*b* have a wedge or triangular shape and the wedge pockets 30*a*-30*d* include a complimentary triangular (or wedge) shape. Each of the wedge pockets 30*a*-30*d* are configured to lay substantially flat when the inflatable wedges 16*c*-16*d* are in a deflated state.

In some embodiments, each of the wedge pockets 30*a*-30*d* defines an internal cavity 48 sized and configured to receive an inflatable wedge 16*a*-16*b* therein. Although two inflatable wedges 16*a*-16*b* are shown in an inflated state in FIG. 4, it will be appreciated that the inflatable wedges 16*a*-16*d* are inserted in a deflated state and subsequently inflated as described in greater detail herein. The inflatable wedges 16*a*-16*d* are positioned within the wedge pockets 30*a*-30*d* such that one or more ports 32*a*-32*f* formed through the top panel 6*a* and positioned within an inner cavity 48 are aligned with openings 35*a*, 35*b* formed through a bottom surface 41 of the inflatable wedge 16*a*-16*d*. In some embodiments, a portion of each of the flow paths 31*a*, 31*b*, such as a portion of a first tube 60*a* defining a portion of the first flow path 31*a*, may be inserted into the openings 35*a*, 35*b*. After being positioned within the wedge pockets 30*a*-30*d*, each of the plurality of inflatable wedges 16*a*-16*d* form a portion of a respective flow path 31*a*, 31*b* such that air flow along the respective flow path 31*a*, 31*b* inflates a set of the plurality of wedges 16*a*-16*d* formed integrally with the selected airflow path 31*a*, 31*b*.

In some embodiments, a second air supply hose 27 (see FIG. 1) is coupled to a valve 4*a*, 4*b* formed integrally with the top panel 6*a*. Each of the valves 4*a*, 4*b* couple the air supply hose 27 (or a nozzle 36 of the air supply hose 27) to an airflow path 31*a*, 31*b* defined within the inflatable transfer mattress 2. In the illustrated embodiments, each of the airflow paths 31*a*, 31*b* are positioned between the top panel 6*a* and the bottom panel 6*b*. When airflow is provided from the air supply hose 27, air flows on a selected airflow path 31*a* and inflates a set of the plurality of inflatable wedges 16*a*, 16*b* coupled to the selected air flow path 31*a* (see FIG. 4). The set of inflated inflatable wedges 16*a*, 16*b* defines a rotational angle 46 with respect to the top panel 6*a* of the inflatable transfer mattress 2. As discussed in greater detail below, the inflatable wedges 16*a*-16*d* rotate a patient positioned on the inflatable transfer mattress 2 from an initial (or flat) position to a rotational position at the rotational angle 46.

In some embodiments, each of the plurality of inflatable wedges 16*a*-16*d* form an integral part of an air flow path 31*a*, 31*b*. For example, as shown in FIG. 6, in some embodiments, a first airflow path 31*a* is defined by a first tube 60*a* (or flow portion) extending from a valve 4*a* to a first port 32*a* formed in the top panel 6*a*. The first port 32*a* is located within an internal cavity 48 defined by a first wedge pocket 30*a*. As used herein, the term tube refers to any enclosed passageway that allows air flow, such as, for example, passageways defined by a portion of the top panel 6*a* and/or the bottom panel 6*b*, passageways defined by material coupled to the top panel 6*a* and/or the bottom panel 6*b* (such as nylon and/or plastic tubes) and/or any other suitable passageway. In some embodiments, the airflow path 31 is positioned within and isolated from the internal cavity defined by the top panel 6*a* and the bottom panel 6*b*.

A first inflatable wedge 16*a* is positioned within the first wedge pocket 30*a* such that a first opening 35*a* formed in a bottom surface 41 of the first inflatable wedge 16*a* is in fluid communication with the first port 32*a* formed in the top panel 6*a*. Air flow provided from the air supply hose 27 flows through the first tube 60*a* and into the first inflatable wedge 16*a*. The first inflatable wedge 16*a* is inflated by the air flow from the first port 32*a*.

A second opening 35*b* formed in the bottom surface 41 of the inflatable wedge 16*a* is aligned with a second port 32*b* formed in the top panel 6*a*. The second port 32*b* is coupled to and/or defines a portion of a second tube 60*b* extending from the second port 32*b* to a third port 32*c*. As air flows into the inflatable wedge 16*a*, a portion of the air is forced out of the second opening 35*b* in the bottom surface 41 and into the second port 32*b* in the top panel 6*a*. The first airflow path 31*a* extends through the second tube 60*b* to the third port 32*c*.

In some embodiments, a second inflatable wedge 16*b* is positioned within the second wedge pocket 30*b* such that a first opening 35*a* formed in the bottom surface 41 of the second inflatable wedge 16*b* is in fluid communication with the third port 32*c* formed in the top panel 6*a*. Air flow provided through the second tube 60*b* flows from the third port 32*c* into the internal volume 42 of the second inflatable wedge 16*b* and inflates the second inflatable wedge 16*b*.

In some embodiments, the second inflatable wedge 16*b* includes a second opening 35*b* extending through a bottom surface 41 thereof. The second hole 41 abuts the top panel 6*a* of the inflatable transfer mattress 2. In some embodiments, a downward pressure is applied to the second inflatable wedge 16*b*, for example, by the wedge pocket 30*b*, such that the second opening 35*b* is at least partially sealed by contact with the top panel 6*a*. In some embodiments, the second inflatable wedge 16*b* includes only the first opening 35*a*. In some embodiments, after the first and second inflatable wedges 16*a*, 16*b* are inflated, a nominal or predetermined airflow is maintained within the airflow path 31 to prevent deflation of the inflatable wedges 16*a*, 16*b* due to air leakage from the openings 35*a*, 35*b* formed in the inflatable wedges 16*a*, 16*b*. Although embodiments are illustrated herein including inflation of a first set of the plurality of inflatable wedges 16*a*, 16*b*, it will be appreciated that inflation of additional sets of the plurality of inflatable wedges 16*a*-16*d* is substantially similar and similar description is not repeated herein.

Figure 7:
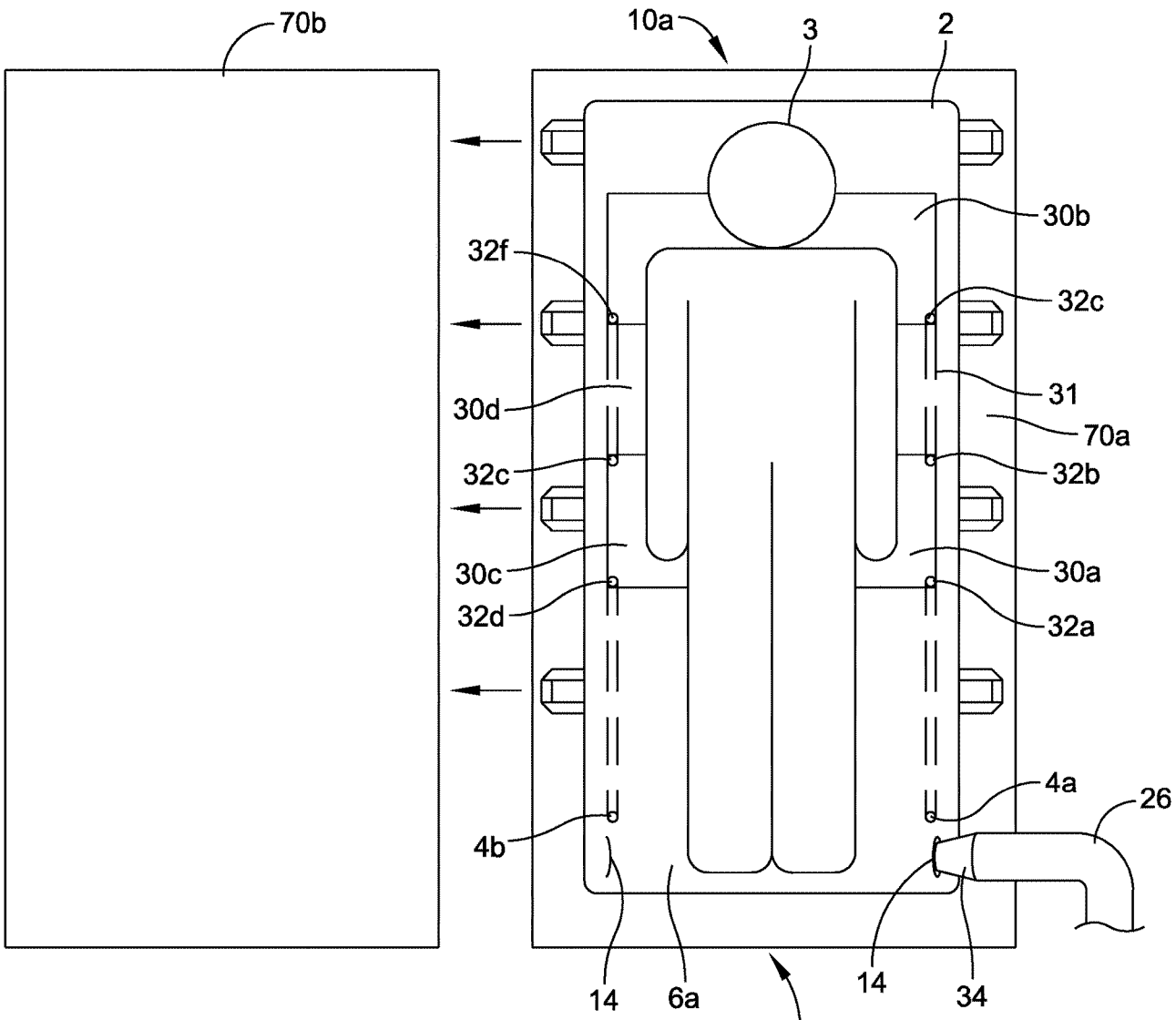
FIG. 7 illustrates a top view of the inflatable transfer mattress of FIG. 1 having a patient thereon, in accordance with some embodiments.

As shown in FIG. 7, in some embodiments, the inflatable transfer mattress 2 is configured to facilitate transfer of a patient 3 between a first surface 70*a* and a second surface 70*b*. An air supply hose 26 is coupled to an inlet 14 in fluid communication with the internal volume defined between the top panel 6*a* and the bottom panel 6*b*. Air flows from the internal volume through a plurality of holes 7 formed in the bottom panel 6*b* to provide lubrication during transfer and deflation after transfer. Each of the handles 44 are positioned along a peripheral edge 8 of the inflatable transfer mattress 2. The handles 44 can include any suitable woven and/or non-woven material coupled to the inflatable transfer mattress 2 and configured to sustain a predetermined force to allow sliding of the inflatable transfer mattress 2. In some embodiments, the handles 44 can be omitted and straps, eyelets, and/or other devices can be configured to allow handles or other transfer mechanism to be attached to and/or detached from the inflatable transfer mattress 1.

Figure 8:
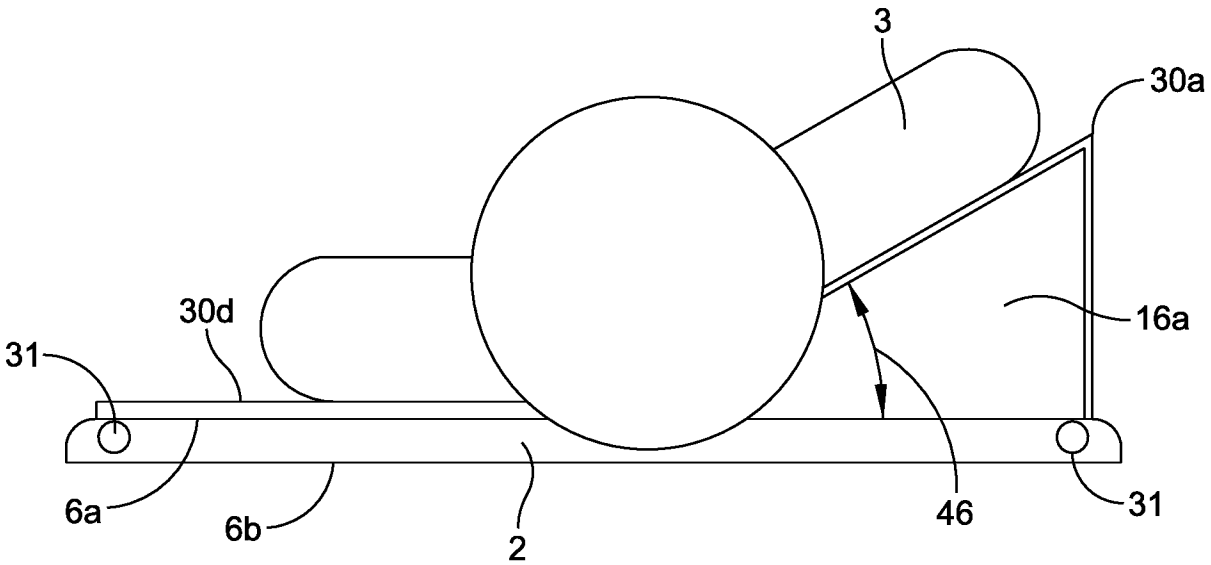
FIG. 8 illustrates a front view of the inflatable transfer mattress of FIG. 7 having a first inflatable wedge inflated to rotate a patient to a predetermined angle, in accordance with some embodiments.

As shown in FIG. 8, in some embodiments, a first set of the inflatable wedges 16*a*, 16*b* are inflated to rotate the patient 3 from a flat (or supine) position to a rotated position with respect to the top panel 6*a*. The inflatable wedges 16*a*-16*d* are positioned within respective wedge pockets 30*a*-30*d* in a deflated state prior to a patient 3 being positioned on the inflatable transfer mattress 2. After positioning the patient 3 on the inflatable transfer mattress 2, an air supply hose 27 is coupled to a first inlet 4*a* to provide airflow to a selected airflow path 31*a*. The airflow inflates a set of inflatable wedges 16*a*, 16*b* in fluid communication with the respective airflow path 31. The selected set of inflatable wedges 16*a*, 16*b* are inflated to rotate the patient 3 to a predetermined rotational angle 46. The predetermined rotation angle 46 can include any suitable angle configured to alleviate pressure on one or more sections of the patient 3, such as, for example, the sacrum. The airflow is maintained by the air supply hose 27 for a predetermined time period. When the air supply is turned off (or the air supply hose 27 is removed), the inflatable wedges 16*a*, 16*b* deflate through openings 35*a*, 35*b* formed in a bottom surface 41 and/or through the airflow path 31.

Figure 9:
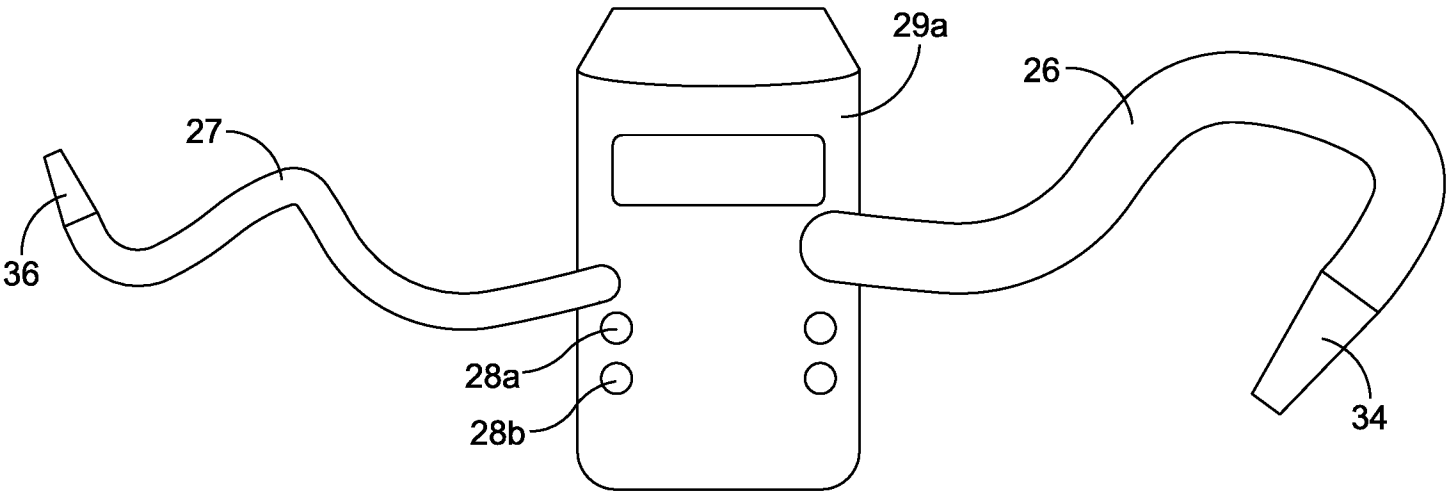
FIG. 9 illustrates an inflation device having a first inflation hose and a second inflation hose, in accordance with some embodiments.
Figure 10:
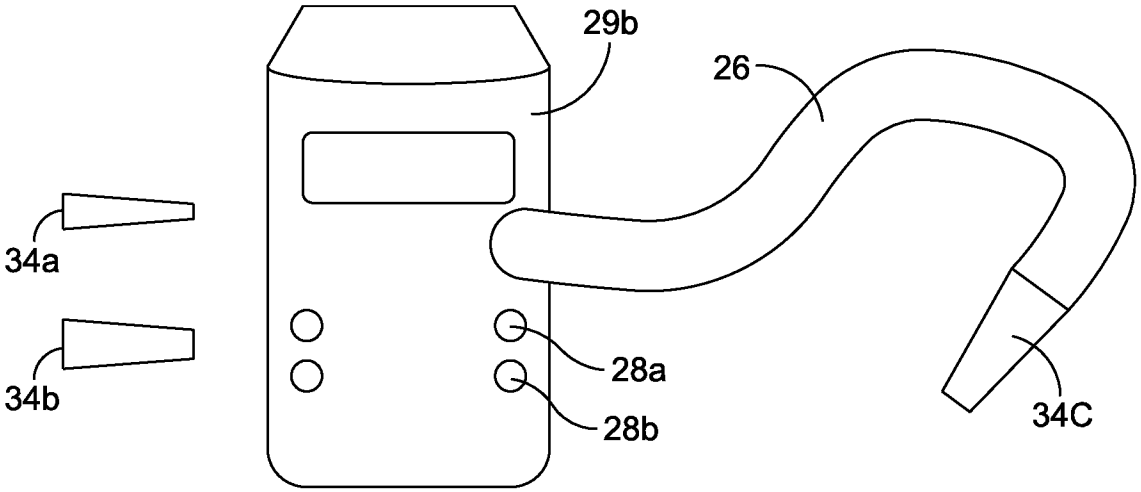
FIG. 10 illustrates an inflation device having a first inflation hose and a plurality of inflation nozzles, in accordance with some embodiments.

FIGS. 9 and 10 illustrate various embodiments of inflation devices 29*a*, 29*b* configured to be coupled to the inflatable transfer mattress 2 described above in conjunction with FIGS. 1-8. As shown in FIG. 9, in some embodiments, a first inflation device 29*a* includes a first air hose 26 having a first diameter and a second air hose 27 having a second diameter. The first diameter is greater than the second diameter. The first air hose 26 includes a first nozzle 34 sized and configured to couple the first air hose 26 to an inlet 14 to provide air flow from the inflation device 29*a* to the internal volume defined by the top panel 6*a* and the bottom panel 6*b*. Airflow from the first air hose 26 inflates the inflatable transfer mattress 2 and provides a lubricating cushion of air between the bottom surface 6*b* and a first surface 70*a* and a second surface 70*b* during transfer.

In some embodiments, the second air hose 27 includes a second nozzle 36 sized and configured to be coupled to at least one of the valves 4*a*, 4*b* to provide airflow to a selected airflow path 31. Airflow from the second air hose 27 is configured to inflate one or more inflatable wedges 16*a*, 16*b* in fluid communication with and/or defining a portion of the airflow path 31. In some embodiments, the inflation device 29*a* includes a plurality of buttons 28*a*, 28*b* configured to selectively provide air flow to the first air hose 26 and/or the second air hose 27.

As shown in FIG. 10, in some embodiments, a second inflation device 29*b* includes a single (or first) air hose 26. The air hose 26 includes a plurality of interchangeable nozzles 34*a*-34*c*. Each of the nozzles 34*a*-34*c* includes a different taper and/or terminal diameter such that each nozzle 34*a*-34*c* is sized and configured to couple the air hose 26 to one of the valves 4*a*, 4*b*, or the inlet 14. In some embodiments, second inflation device 29*b* includes a plurality of buttons 28*a*, 28*b* configured to provide variable flow rates through the air supply hose 26 depending on the selected nozzle 34*a*-34*c* and/or the selected inflation target (i.e., airflow path 31 and/or the internal volume between top panel 6*a* and bottom panel 6*b*). Although specific embodiments are illustrated, it will be appreciated that any suitable inflation device can be used to inflate the inflatable transfer mattress 2 and/or the plurality of inflatable wedges 16*a*, 16*b*, and are within the scope of this disclosure.

Figure 11:
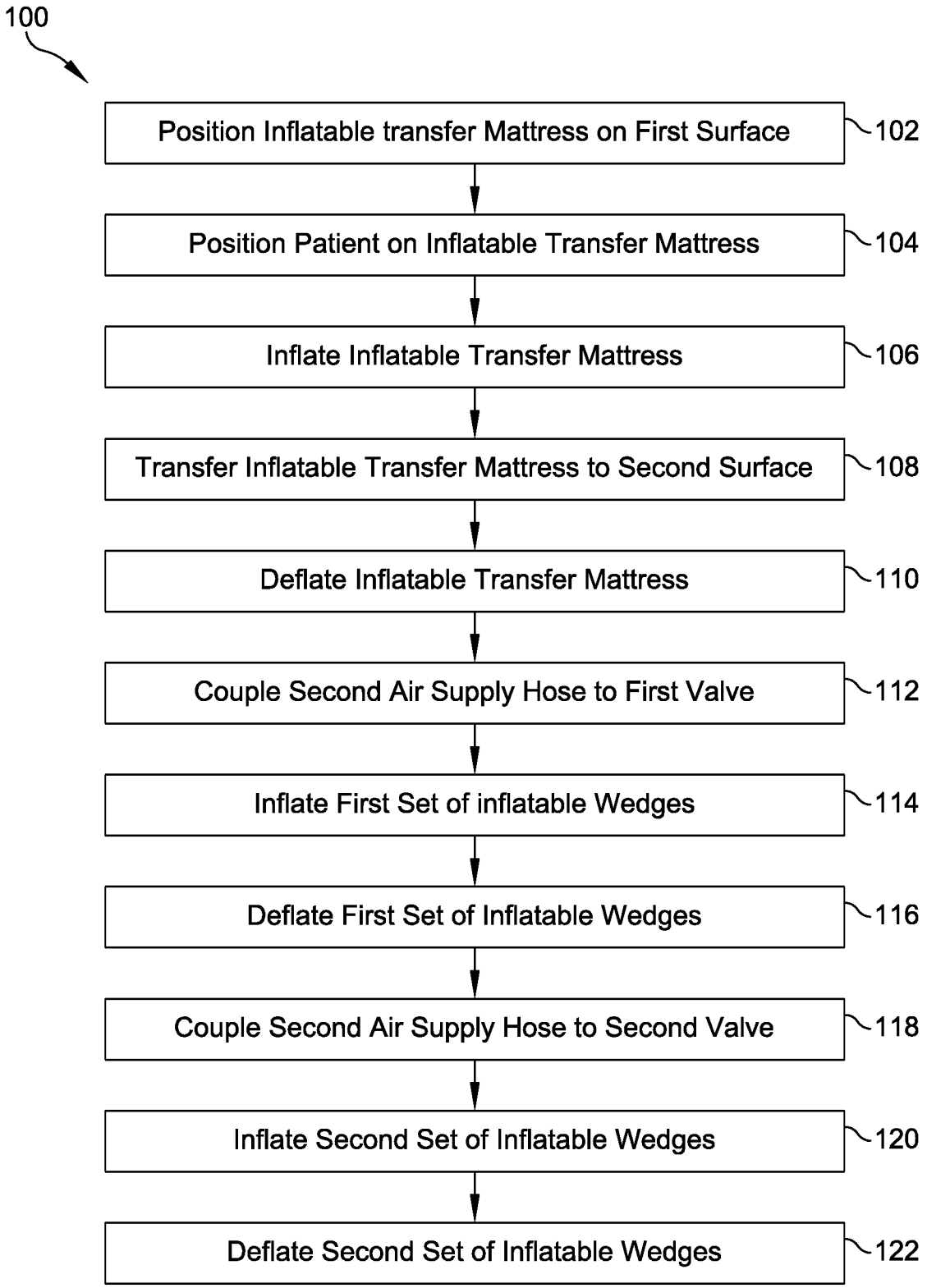
FIG. 11 illustrates a method of positioning and rotating a patient using the inflatable transfer mattress of FIG. 1, in accordance with some embodiments.

FIG. 11 illustrates a method of 100 of positioning and rotating a patient 3 using an inflatable transfer mattress 2, in accordance with some embodiments. At step 102, an inflatable transfer mattress 2 is positioned on a first surface 70*a*. The inflatable transfer mattress 2 is positioned such that a bottom layer 6*b* defining a plurality of holes 7 is in contact with the first surface 70*a*. The inflatable transfer mattress 2 includes a rotational positioning device 20 formed integrally therewith. The first surface 70*a* can include any suitable surface, such as a bed, gurney, surgery table, imaging table, etc.

At step 104, a patient 3 is positioned on the inflatable transfer mattress 2. At step 106, the inflatable transfer mattress 2 is inflated by coupling a first air hose 26 of an inflation device 29*a*, 29*b* to an inlet 14 in fluid communication with an internal volume defined between the top layer 6*a* and the bottom layer 6*b* of the inflatable transfer mattress 2. The air flow from the inflation device 29*a*, 29*b* is maintained during at least subsequent step 108 of the method 100.

At step 108, the inflatable transfer mattress 2 and the patient 3 are transferred from the first surface 70*a* to a second surface 70*b*. The second surface 70*b* can include any suitable surface, such as a bed, gurney, surgery table, imaging table, etc. Air flows from the internal volume defined between the top layer 6*a* and the bottom layer 6*b* through the plurality of holes 7 formed in the bottom layer 6*b*. The airflow through the plurality of holes 7 provides an air lubrication layer between the inflatable transfer mattress 2 and the first and second surfaces 70*a*, 70*b*. In some embodiments, a transfer force is provided by one or more operators using the handles 44 to push and/or pull the inflatable transfer mattress 2 from the first surface 70*a* to the second surface 70*b*

At step 110, the air flow from the inflation device 29*a*, 29*b* is stopped and the inflatable transfer mattress 2 deflates. Deflation may occur due to airflow through the plurality of holes 7 and/or through a deflation valve (not shown). The rate of deflation caused by airflow through the plurality of holes 7 prevents injury to the patient 3 during deflation.

At step 112, a second air supply hose 27 (and/or the first air supply hose 26 with a second nozzle 34*a*-34*c*) is coupled to a first valve 4*a* in fluid communication with a first airflow path 31. The first airflow path 31*a* includes one or more tubes 60*a*, 60*b* and a first set of inflatable wedges 16*a*, 16*b* in fluid communication.

At step 114, airflow is provided from the second air supply hose 27 to the first airflow path 31 to inflate the first set of inflatable wedges 16*a*, 16*b* on the airflow path 31. The first set of inflatable wedges 16*a*, 16*b* are inflated to define a predetermined angle 46 with respect to the top panel 6*a*. Inflation of the first set of inflatable wedges 16*a*, 16*b* rotates the patient 3 (or a first portion of the patient 3) to the predetermined rotation angle 46 defined by the first set of inflatable wedges 16*a*, 16*b*. At step 116, airflow from the inflation device 29*a*, 29*b* is stopped (or the second air supply hose 27 is removed) and the first set of inflatable wedges 16*a*, 16*b* are deflated.

At step 118, the air supply hose 27 is coupled to a second valve 4*b* in signal communication with a second airflow path 31*b*. The second airflow path 31*b* includes one or more tubes and a second set of inflatable wedges 16*c*, 16*d* in fluid communication. At step 120, airflow is provided from the second air supply hose 27 to the second airflow path 31*b* to inflate the second set of inflatable wedges 16*c*, 16*d* on the airflow path 31*b*. The second set of inflatable wedges 16*c*, 16*d* are inflated to define a predetermined angle 46 with respect to the top panel 6*a*. Inflation of the second set of inflatable wedges 16*c*, 16*d* rotates the patient 3 (or a second portion of the patient 3) to the predetermined rotation angle 46 defined by the second set of inflatable wedges 16*c*, 16*d*. In some embodiments, the predetermined angle 46 of the second set of inflatable wedges 16*c* 16*d* is a mirror image (or opposite) the predetermined angle 46 defined by the first set of inflatable wedges 16*a*, 16*b*. At step 122, airflow from the inflation device 29*a*, 29*b* is stopped (or the second air supply hose 27 is removed) and the second set of inflatable wedges 16*c*, 16*d* are deflated.

Although the subject matter has been described in terms of exemplary embodiments, it is not limited thereto. Rather, the appended claims should be construed broadly, to include other variants and embodiments, which may be made by those skilled in the art.

What is claimed is:

1. An inflatable mattress, comprising:

a top panel;

a bottom panel having a perimeter sealingly coupled to a perimeter of the top panel to define an internal volume therebetween, wherein the internal volume is configured to receive an air flow therein;

a first wedge pocket coupled to an outer surface of the top panel;

a first inflatable wedge sized and configured to be inserted into the first wedge pocket, wherein the first inflatable wedge is configured to be transitioned from a deflated state to an inflated state, and wherein the first inflatable wedge is configured to rotate a patient to a predetermined angle with respect to the top panel in the inflated state; and a first airflow path extending from a first valve to a first opening formed in the first inflatable wedge, wherein the valve is formed integrally with the top panel, and wherein the first airflow path comprises a first enclosed path positioned within the internal volume and extending from the valve to a first port formed through the top panel.

2. The inflatable mattress of claim 1, comprising a second wedge pocket coupled to the outer surface of the top panel;

a second inflatable wedge sized and configured to be inserted into the second wedge pocket, wherein the second inflatable wedge is configured to be transitioned from a deflated state to an inflated state, and wherein the second inflatable wedge is configured to rotate the patient to the predetermined angle in the inflated state; and a second airflow path extending from a second valve to a first opening formed in the second inflatable wedge.

3. The inflatable mattress of claim 1, wherein the first wedge pocket defines a complimentary geometry with respect to the first inflatable wedge when the first inflatable wedge is in the inflated state.

4. The inflatable mattress of claim 1, comprising a plurality of stringers positioned within the internal volume, wherein a first edge of each of the plurality of stringers is coupled to the top panel and a second edge of each of the plurality of stringers is coupled to the bottom panel.

5. The inflatable transfer mattress of claim 1, wherein the bottom panel defines a plurality of holes configured to provide air flow from the internal volume to an area located between the bottom panel and a surface.

6. The inflatable transfer mattress of claim 1, wherein the predetermined angle is an angle in the range of 0-30 degrees.

7. The inflatable transfer mattress of claim 1, comprising an inlet formed integrally with the top panel, wherein the inlet is configured to provide fluid communication between the internal volume and an air supply hose, wherein the inlet has a first diameter and the first valve has a second diameter, and wherein the first diameter and the second diameter are different.

8. An inflatable transfer mattress, comprising:

a top panel;

a bottom panel having a perimeter sealingly coupled to a perimeter of the top panel to define an internal volume therebetween, wherein the internal volume is configured to receive an air flow therein, wherein the bottom panel defines a plurality of holes configured to provide air flow from the internal volume to an area located between the bottom panel and a surface;

a first wedge pocket coupled to an outer surface of the top panel;

a first inflatable wedge sized and configured to be inserted into the first wedge pocket, wherein the first inflatable wedge is configured to be transitioned from a deflated state to an inflated state, and wherein the first inflatable wedge is configured to rotate a patient to a first predetermined angle with respect to the top panel in the inflated state; and a first airflow path extending from a first valve to a first opening formed in the first inflatable wedge, wherein the valve is formed integrally with the top panel, and wherein the first airflow path comprises a first enclosed path positioned within the internal volume and extending from the valve to a first port formed through the top panel.

9. The inflatable transfer mattress of claim 8, comprising:

a second wedge pocket coupled to the outer surface of the top panel;

a second inflatable wedge sized and configured to be inserted into the second wedge pocket, wherein the second inflatable wedge is configured to be transitioned from a deflated state to an inflated state, and wherein the second inflatable wedge is configured to rotate the patient to a second predetermined angle in the inflated state; and a second airflow path extending from a second valve to a first opening formed in the second inflatable wedge.

10. The inflatable transfer mattress of claim 9, wherein the first predetermined angle is opposite the second predetermined angle.

11. The inflatable mattress of claim 8, comprising:

a second wedge pocket coupled to the outer surface of the top panel; and a second inflatable wedge sized and configured to be inserted into the second wedge pocket, wherein the second inflatable wedge is configured to be transitioned from a deflated state to an inflated state, and wherein the second inflatable wedge is configured to rotate the patient to the predetermined angle in the inflated state, and wherein the first airflow path extends from the first valve to a first opening formed in the second inflatable wedge.

12. The inflatable mattress of claim 11, wherein the first airflow path comprises a second enclosed path extending from a second port formed through the top panel and aligned with the second opening formed through the first inflatable wedge to a third port formed in the top panel and aligned with the first opening formed through the second inflatable wedge.

13. The inflatable transfer mattress of claim 8, wherein the first valve is formed integrally with the top panel, and wherein the first airflow path comprises a first enclosed path positioned within the internal volume and extending from the first valve to a first port formed through the top panel.

14. An inflatable mattress, comprising:

a top panel;

a bottom panel having a perimeter sealingly coupled to a perimeter of the top panel to define an internal volume therebetween, wherein the internal volume is configured to receive an air flow therein;

a first wedge pocket coupled to an outer surface of the top panel;

a first inflatable wedge sized and configured to be inserted into the first wedge pocket, wherein the first inflatable wedge is configured to be transitioned from a deflated state to an inflated state, and wherein the first inflatable wedge is configured to rotate a patient to a predetermined angle with respect to the top panel in the inflated state; and a first airflow path extending from a first valve to a first opening formed in the first inflatable wedge;

a second wedge pocket coupled to the outer surface of the top panel; and a second inflatable wedge sized and configured to be inserted into the second wedge pocket, wherein the second inflatable wedge is configured to be transitioned from a deflated state to an inflated state, and wherein the second inflatable wedge is configured to rotate the patient to the predetermined angle in the inflated state, and wherein the first airflow path extends from a second opening formed in the first inflatable wedge to a first opening formed in the second inflatable wedge, and wherein the first airflow path comprises a second enclosed path extending from a second port formed through the top panel and aligned with the second opening formed through the first inflatable wedge to a third port formed in the top panel and aligned with the first opening formed through the second inflatable wedge.

15. The inflatable mattress of claim 14, comprising a second airflow path extending from a second valve to the first opening formed in the second inflatable wedge.

16. The inflatable mattress of claim 14, wherein the first wedge pocket defines a complimentary geometry with respect to the first inflatable wedge when the first inflatable wedge is in the inflated state.

17. The inflatable mattress of claim 14, comprising a plurality of stringers positioned within the internal volume, wherein a first edge of each of the plurality of stringers is coupled to the top panel and a second edge of each of the plurality of stringers is coupled to the bottom panel.

18. The inflatable transfer mattress of claim 14, wherein the bottom panel defines a plurality of holes configured to provide air flow from the internal volume to an area located between the bottom panel and a surface.

19. The inflatable transfer mattress of claim 14, wherein the predetermined angle is an angle in the range of 0-30 degrees.

20. The inflatable transfer mattress of claim 14, comprising an inlet formed integrally with the top panel, wherein the inlet is configured to provide fluid communication between the internal volume and an air supply hose, wherein the inlet has a first diameter and the first valve has a second diameter, and wherein the first diameter and the second diameter are different.

* * * * *